US006832391B1

(12) United States Patent
Bower

(10) Patent No.: US 6,832,391 B1
(45) Date of Patent: Dec. 21, 2004

(54) WEIGHT LIFTING GLOVE

(75) Inventor: Danny Michael Bower, Norman, OK (US)

(73) Assignee: Century Incorporated

( * ) Notice: Subject to any disclaimer, the term of this patent is extended or adjusted under 35 U.S.C. 154(b) by 714 days.

(21) Appl. No.: 09/954,345

(22) Filed: Sep. 17, 2001

(51) Int. Cl.[7] ..... A41D 19/00
(52) U.S. Cl. ..... 2/159; 2/161.6
(58) Field of Search ..... 2/16, 20, 158, 2/159, 160, 161.1, 161.3, 161.4, 161.6, 161.7, 161.8, 163, 164, 167, 168, 169; 128/878, 879; 482/44, 49; 602/21, 22

(56) References Cited

U.S. PATENT DOCUMENTS 3,647,505 A * 3/1972 Bjorn-Larsen ..... 427/210
3,918,096 A 11/1975 Lim
4,051,553 A 10/1977 Howard
4,183,100 A 1/1980 De Marco
4,245,357 A 1/1981 Connelly
4,691,387 A 9/1987 Lopez
5,214,799 A * 6/1993 Fabry ..... 2/20
5,418,980 A 5/1995 Kelly
5,479,660 A 1/1996 Najac
5,581,809 A * 12/1996 Mah ..... 2/20
5,603,118 A * 2/1997 Solomon ..... 2/20
5,675,839 A * 10/1997 Gordon et al. ..... 2/159
5,697,104 A 12/1997 Welton
5,790,980 A * 8/1998 Yewer, Jr. ..... 2/20
6,035,444 A * 3/2000 McGrew ..... 2/161.6
6,092,238 A * 7/2000 Fierabend, Jr. ..... 2/161.8
6,098,200 A 8/2000 Minkow et al.
6,185,747 B1 * 2/2001 Hughes ..... 2/161.6

* cited by examiner

*Primary Examiner*—Danny Worrell
*Assistant Examiner*—Gary L. Welch
(74) *Attorney, Agent, or Firm*—Dunlap Codding & Rogers

(57) ABSTRACT

A glove for protecting an individual's hand is provided. The glove includes a palm covering shaped to substantially correspond to the shape of at least a portion of the palmar side of the individual's hand, and a back covering shaped to substantially correspond to the shape of at least a portion of the dorsal side of the individual's hand. The back covering is secured to the palm covering so as to form a hand receiving opening, a thumb stall, and a plurality of finger stalls. The glove further includes a palm padding secured to selected areas of the palm covering so as to provide cushioning for the palmar side of the individual's hand, and a slip resistant material provided on selected areas of the palm covering to facilitate the gripping of an object by the individual's hand.

16 Claims, 5 Drawing Sheets

WEIGHT LIFTING GLOVE

CROSS-REFERENCE TO RELATED APPLICATIONS

Not applicable.

BACKGROUND OF THE INVENTION

1. Field of the Invention

The present invention relates generally to gloves, and more particularly, but not by way of limitation, to an improved glove having a slip resistant material and a padding provided on selected areas to facilitate the gripping of an object, such as a weight lifting implement.

2. Brief Description of the Related Art

Many types of gloves have been designed to increase the comfort and enhance the performance of individuals participating in a variety of sports and activities. For example, gloves have been designed for golfers, bowlers, waterskiers, football players, baseball players, basketball players, and racquet ball players. In general, such gloves are intended to protect the individuals hand from injury and enhance the individuals grip on a ball or implement, such as a bat or racquet.

Likewise, numerous gloves have been proposed for weight lifting. To protect an individual's hand, weight lifting gloves are typically provided with padding positioned across the palm and fingers of the individual for the purpose of providing cushioning for an individual's hand while in the process of exerting a force on a weight lifting implement, such as a dumbbell, a chin-up bar, or a weight lifting bar. While such padding serves the function of providing protection to an individual's hand, the padding increases the bulk of the glove and thus causes the glove to bunch in the palm of the individual upon gripping a weight lifting implement. The bunched material has the effect of requiring the individual to expend considerably more effort to maintain a tight grip on the weight lifting implement. As a result, the individual may lose his grip on the weight lifting implement prematurely which may lead to the injury of the individual or a bystander. At the least, the premature fatiguing of the individual's grip can lead to the individual having to stop an exercise before the intended muscle group is adequately exercised.

To this end, a need exists for a glove which cushions an individual's hand and which enhances the individual's grip when participating in the activity of weight lifting. It is to such a glove that the present invention is directed.

BRIEF DESCRIPTION OF THE SEVERAL VIEWS OF THE DRAWING

FIG. 6 is a partial cutaway, plan view of the palm covering of the glove of FIG. 5.

DETAILED DESCRIPTION OF THE INVENTION

Figure 1:
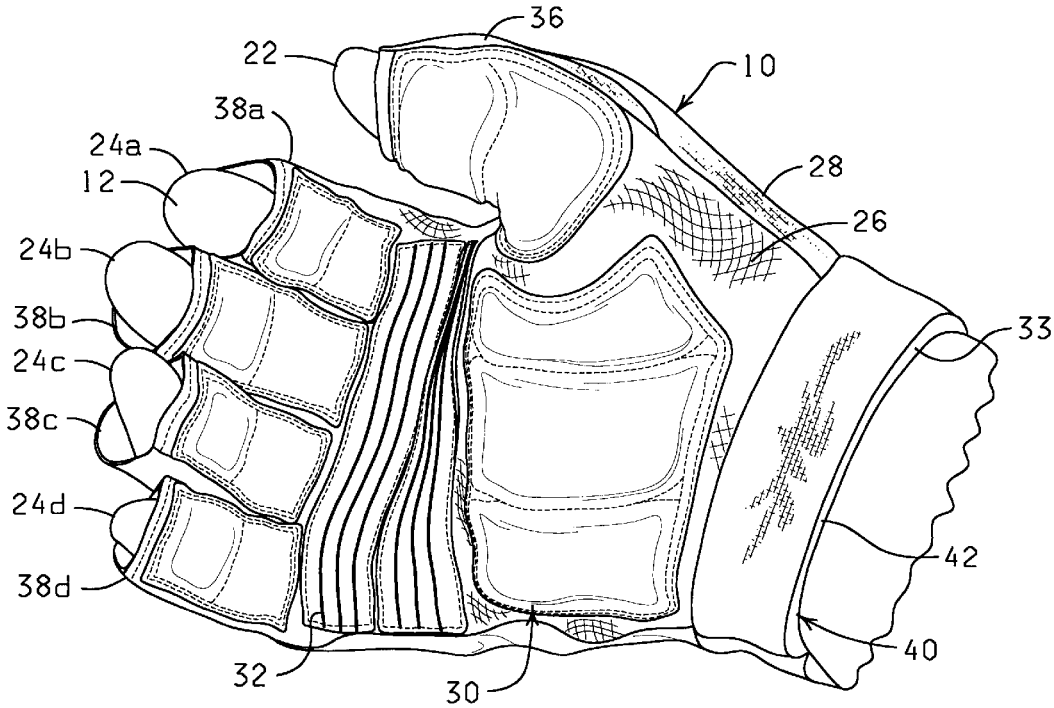
FIG. 1 is a perspective view of a glove constructed in accordance with the present invention shown donned on an individual's hand.

Referring now to the drawings, and more particularly to FIG. 1, a glove 10 constructed in accordance with the present invention is shown donned on a hand 12 of an individual. The hand 12 of the individual is characterized as having a radial or thumb side, an ulnar or little finger side, a dorsal side, and a palmar side. In addition, the hand 12 includes a thumb 22 and a plurality of fingers 24*a*–24*d* which include an index finger, a middle finger, a ring finger, and a little finger, respectively. Although not depicted in FIG. 1, it is well known that the hand 12 further includes a series of creases extending transversely across the palmar side of the hand 12 to facilitate closing of the hand 12. Two of the more major creases are commonly referred to as the proximal crease which extends from the radial side of the hand toward the ulnar side and the distal crease which extends from the ulnar side toward the radial side in a substantially parallel relationship with respect to one another.

The glove 10 is constructed to protect the hand 12 of the individual while enhancing the individual's grip on an object, such as a weight lifting implement. The glove 10 includes a palm covering 26, a back covering 28, a palm padding 30 secured to selected areas of the palm covering 26 so as to provide cushioning for the palmar side of the individual's hand 12, and a slip resistant material 32 formed on selected areas of the palm covering 26 to facilitate the gripping of an object by the individual's hand 12. The back covering 28 is secured to the palm covering 26 so as to form a glove opening 33, a hand receiving space (not shown), a thumb stall 36 and a plurality of finger stalls 38*a*–38*d*.

As shown in FIG. 1, the thumb stall 36 and each of the finger stalls 38*a*–38*d* has an open end and a length so as to be positioned at about the first joint of the thumb 22 and the fingers 24*a*–24*d*, respectively. It will be understood, however, that the glove 10 may be constructed such that the thumb stall 36 and the finger stalls 38*a*–38*d* can be formed to have any length including close ended so as to cover the entire thumb 22 and the fingers 24*a*–24*d*.

To aid in reducing the tendency of the palm covering 26 from bunching upon the individual gripping an object, the glove 10 is preferably constructed such that the thumb stall 36 and the finger stalls 38*a*–38*d* are pre-curved so as to be closely adapted to the anatomy and natural configuration of the hand 12. Methods of constructing gloves to have such a shape are well known in the art. Thus, no further description is believed necessary in order for one skilled in the art to construct the glove 10 of the present invention.

Figure 2:
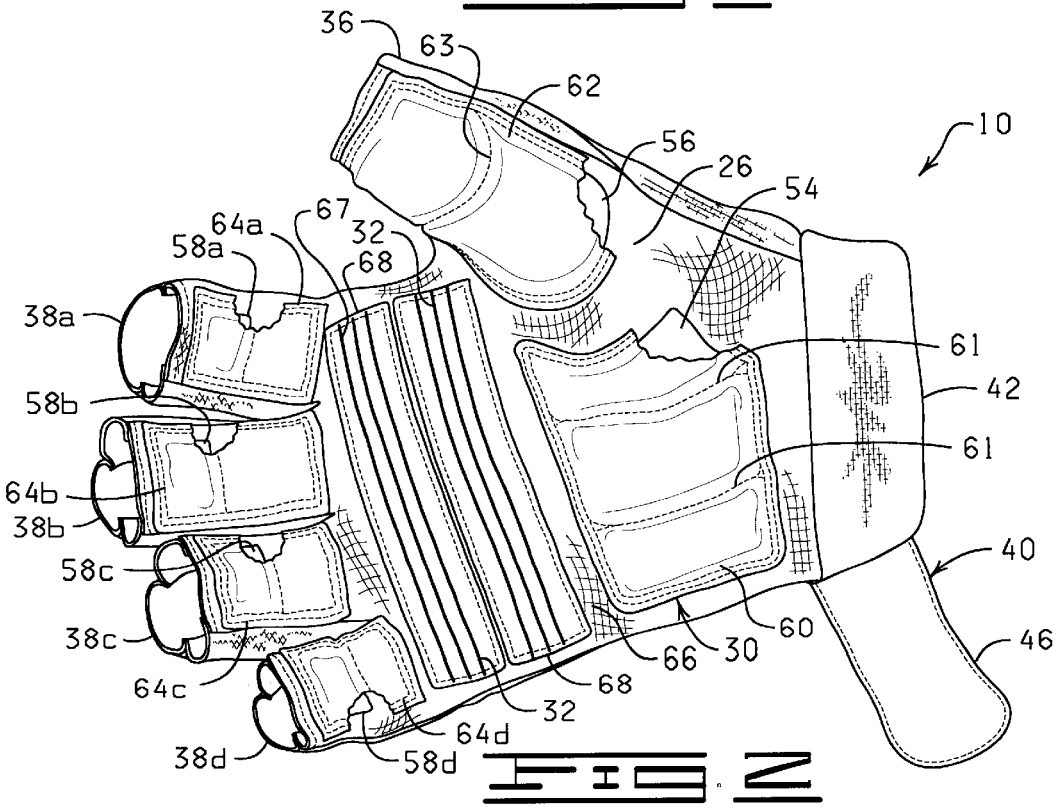
FIG. 2 is a partial cutaway, plan view of the palm covering of the glove of FIG. 1.
Figure 3:
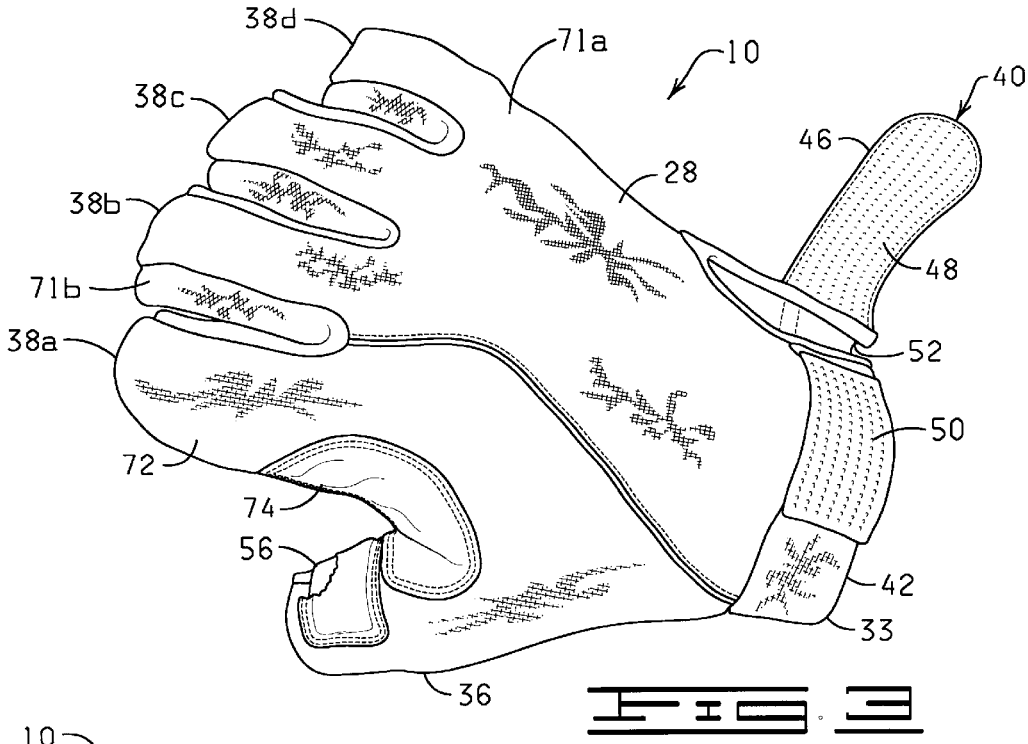
FIG. 3 is a plan view of the back covering of the glove of FIG. 1.

As shown in FIGS. 1–3, the glove 10 further includes a strap assembly 40 for securing the glove 10 about the wrist of the individual. The strap assembly 40 includes a cuff 42 extending circumferentially about the glove opening 33. The cuff 42 is preferably constructed of an elastic material. The strap assembly 40 further includes a closure strap 46 extending from the palm covering 26. As best shown in FIG. 3, the closure strap 46 is provided with a hook and loop type fastener patch 48 which is adapted to be connected to a corresponding hook and loop type fastener patch 50 secured to the portion of the cuff 42 positioned adjacent the back covering 28. A slit 52 is provided between the palm covering 26 and the back covering 28 to permit the glove 10 to be adjustably fastened to the individual's hand 12 upon mating the hook and loop type fastener patch 48 with the hook and loop type fastener patch 50, and yet permit the glove 10 to be easily removed from the individual's hand 12 upon releasing the hook and loop type fastener patch 48 from the hook and loop type fastener patch 50. It will be appreciated by those of ordinary skill in the art that numerous types of strap assemblies are known in the art which would be suitable for use in the glove 10.

Referring now to FIG. 2, the palm covering 26 is shown to be shaped to substantially correspond to the shape of the palmar side of the individual's hand 12. The palm covering 26 is preferably constructed of a durable fabric, such as leather, suede, or a synthetic equivalent.

The palm padding 30 is secured to selected areas of the palm covering 26. More specifically, the palm padding 30 includes a heel pad 54, a thumb pad 56, and a plurality of finger pads 58*a*–58*d*. The heel pad 54, the thumb pad 56, and the finger pads 58*a*–58*d* are preferably constructed from a resilient, impact absorbing material. Materials such as natural or synthetic rubber; natural or synthetic rubber foams with either open or closed structures; polymeric foams with either open or closed structures (including, but not limited to polyurethane foams and polystyrene foams); and conventionally available impact absorbent gels and gel foams which may or may not require a pliable membrane containment pouch may be suitable for construction of the pads.

Each of the pads 54, 56, and 58*a*–58*d* is interposed between the palm covering 26 and a patch of durable material, such as leather. More specifically, the heel pad 54 is secured to the palm covering 26 with a patch 60 such that the heel pad 54 is secured to a lower portion of the palm covering 26 to provide cushioning for the heel of the individual's hand 12. The heel pad 54 and the patch 60 are provided with a plurality of longitudinal stitches 61 to further facilitate movement of the hand 12. The thumb pad 56 is secured to the thumb stall 36 with a patch 62. The thumb pad 56 and the patch 62 are provided with a medial stitch 63 corresponding to the second thumb joint to facilitate movement of the individual's thumb 22. To further facilitate the movement of the thumb 22, the thumb pad 56 is preferably secured to the palm covering 26 in a spaced relation relative to the heel pad 54. Finally, the finger pads 58*a*–58*d* are secured to the finger stalls 38*a*–38*d*, respectively, with patches 64*a*–64*d*, respectively. The finger pads 58*a*–58*d* are preferably connected to the palm covering 26 such that the finger pads 58*a*–58*d* correspond with the portion of the fingers extending between the first and second joints of the fingers. However, the patches 64*a*–64*d* are dimensioned to also extend over the portion of the fingers extending between the second and third joints of the fingers.

By securing the heel pad 54, the thumb pad 56, and the finger pads 58*a*–58*d*, in the manner described above, a channel 66 extending transversely across a medial portion of the palm covering 26 is formed. It will be appreciated that the channel 66 substantially corresponds with the proximal and distal creases of the hand 12 when the glove 10 is donned on the individual's hand 12. The channel 66 functions as a cradle for receiving an object, such as a weight lifting implement, across the palm of the individual's hand 12. Furthermore, because the heel pad 54, the thumb pad 56, and the finger pads 58*a*–58*d* provide for an increased thickness relative to the portion of the palm covering 26 corresponding with the channel 66, leverage on the object positioned in the channel 66 of the palm covering 26 is increased, thereby enhancing the individual's grip on the object.

To further enhance the individual's grip, the slip resistant material 32 is provided on the palm covering 26 along the channel 66. As shown in FIG. 2, the slip resistant material 32 is a plurality of raised friction elements 67 formed on a pair of webs of material 68 which are in turn secured to the palm covering 26 along the channel 66. The webs of material 68 can be constructed of any material suitable for receiving the raised friction elements 67. The webs of material 68 are secured to the palm covering 26 in a substantially parallel relationship with the adjacent edges of the webs of material 68 extending transversely across the palm covering 26 so as to correspond with the major creases of the hand 12 and thereby facilitate the folding of the palm covering 26 without resulting in the bunching of the webs of material 68.

The raised friction elements 67 can be fabricated of any anti-slip material, such as rubber. Furthermore, the raised friction elements 67 may be formed directly on the palm covering 26 without use of the webs of material 68. A method of applying a resinous material to an elastic open mesh fabric in spaced globs on a narrow band to form friction protrusions on the material is disclosed in U.S. Pat. No. 3,647,505 issued to Bjorn-Larsen which is expressly incorporated herein by reference.

It will also be appreciated by those of ordinary skill in the art that the slip resistant material 32 can be any material that can be applied the entire palm covering 26 or only the channel 66 to provide a tackified surface in a manner well known in the art.

Referring now to FIG. 3, the back covering 28 is shaped to substantially correspond to the shape of the dorsal side of the individual's hand 12. The back covering 28 is preferably constructed, at least in part, of a breathable, stretch knit fabric so that the back covering 28 conforms to the contour of the dorsal side of the individual's hand 12. In particular, the back covering 28 is shown to be constructed of a first material 71*a* and a second material 71*b*. By way of example, the first material 71*a* can be LYCRA SPANDEX and the second material 71*b* nylon. The back covering 28 may further include a moisture absorbing panel 72 constructed of a material such as terry cloth, so as to permit the individual to wipe perspiration from his face when exercising. The moisture absorbing panel 72 extends along the thumb stall 36 and the finger stall 38*a* and down toward the glove opening 33.

The back covering 28 is further provided with a reinforcing patch 74 secured to an area between the thumb stall 36 and finger stall 38*a* to provide additional protection to the corresponding portion of the individual's hand 12 when performing certain exercises such as an exercise commonly referred to as a "hammer curl" with a dumbbell. Although not shown, the reinforcing patch 74 can be used to secure a piece of padding which corresponds with the reinforcing patch 74 to provide additional protection.

The thumb pad 56 described above in reference to the palm covering 26 is further extended around the thumb stall 36 to cooperate with the reinforcing patch 74 to protect the individual's hand 12 during such an exercise and also to cushion the thumb 22 of the individual when the individual is gripping a weight lifting implement.

Figure 4:
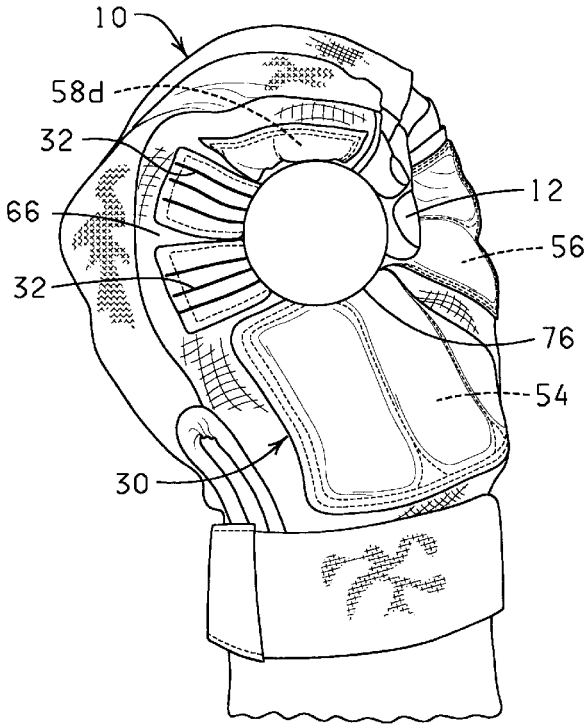
FIG. 4 is a side elevational view of the glove of FIG. 1 shown gripped about a weight lifting implement.

Referring now to FIG. 4, the glove 10 is shown donned on the hand 12 of an individual and being utilized to grip an object, such as a weight lifting bar 76. The unique construction of the glove 10 permits the individual to tightly grip the weight lifting bar 76 without having to expend any unnecessary energy, while also cushioning the portions of the individual's hand 12 most susceptible to injury, namely the heel, thumb and fingers. This is accomplished, in part, by the palm padding 30 which includes the heel pad 54, the thumb pad 56, and the finger pads 58*a*–58*d* (only the finger pad 58*d* being visible in FIG. 4) cooperating to form the channel 66. With the weight lifting bar 76 positioned within the channel 66 and the individual's hand 12 gripped about the weight lifting bar 76, the increased thickness provided by the heel pad 54, the thumb pad 56, and the finger pads 58*a*–58*d* increase the leverage exerted on the weight lifting bar 76 by the individual. The grip on the weight lifting bar 76 is further enhanced by the engagement of the weight lifting bar 76 with the slip resistant material 32 positioned in the channel 66.

Figure 5:
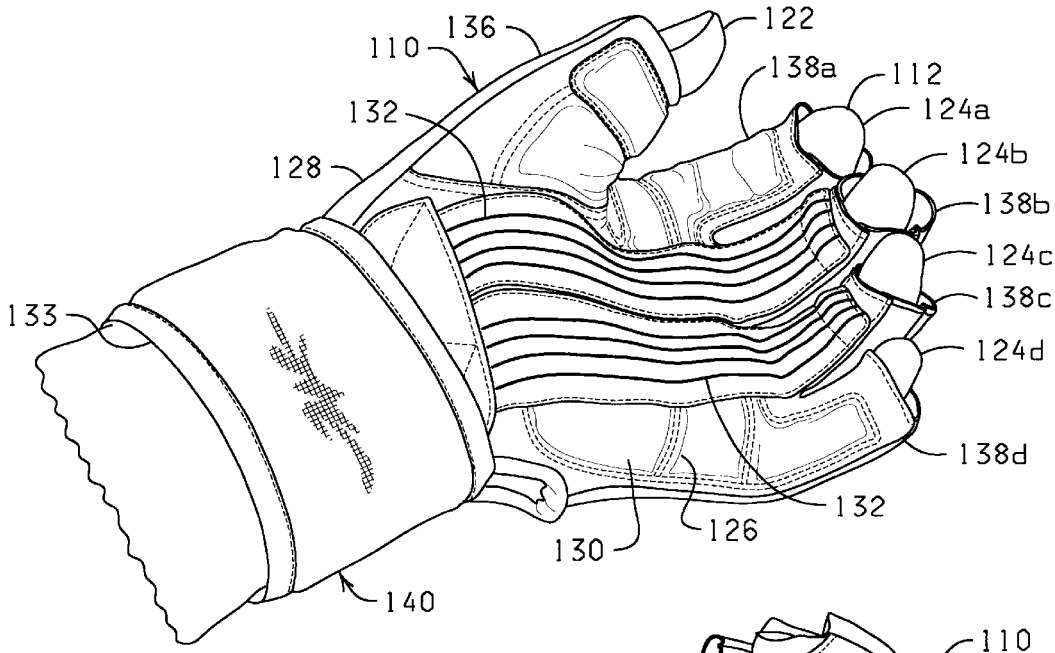
FIG. 5 is a perspective view of another embodiment of glove constructed in accordance with the present invention shown donned on an individual's hand.

Referring now to FIG. 5, another embodiment of a glove 110 constructed in accordance with the present invention is shown donned on a hand 112 of an individual. The hand 112 of the individual is characterized as having a radial or thumb side, an ulnar or little finger side, a dorsal or back covering, and a palmar or palm covering. In addition, the hand 112 includes a thumb 122 and a plurality of fingers 124*a*–124*d* which include an index finger, a middle finger, a ring finger, and a little finger, respectively. Although not depicted in FIG. 5, the hand 112 further includes a series of creases extending transversely across the palmar side of the hand 112 to facilitate closing of the hand 112. Two of the more major creases are commonly referred to as the proximal crease which extends from the radial side of the hand toward the ulnar side and the distal crease which extends from the ulnar side toward the radial side in a substantially parallel relationship with respect to one another.

The glove 110 is constructed to protect the hand 112 of the individual while enhancing the individual's grip on an object, such as a weight lifting implement. The glove 110 includes a palm covering 126, a back covering 128, a palm padding 130 secured to selected areas of the palm covering 126 so as to provide cushioning for the palmar side of the individual's hand 112, and a slip resistant material 132 provided on selected areas of the palm covering 126 to facilitate the gripping of an object by the individual's hand 112. The back covering 128 is secured to the palm covering 126 so as to form a glove opening 133, a hand receiving space (not shown), a thumb stall 136 and a plurality of finger stalls 138*a*–138*d*.

As shown in FIG. 5, the thumb stall 136 and each of the finger stalls 138*a*–138*d* has an open end and a length so as to be positioned at about the first joint of the thumb 122 and the fingers 124*a*–124*d*, respectively. It will be understood, however, that the glove 110 may be constructed such that the thumb stall 136 and the finger stalls 138*a*–138*d* can be formed to have any length including close ended so as to cover the entire thumb 122 and the fingers 124*a*–124*d*.

To aid in reducing the tendency of the palm covering 126 from bunching upon the individual gripping an object, the glove 110 is preferably constructed such that the thumb stall 136 and the finger stalls 138*a*–138*d* are pre-curved so as to be closely adapted to the anatomy and natural configuration of the hand 112. Methods of constructing gloves to have such a shape are well known in the art. Thus, no further description is believed necessary in order for one skilled in the art to construct the glove 110 of the present invention.

Figure 7:
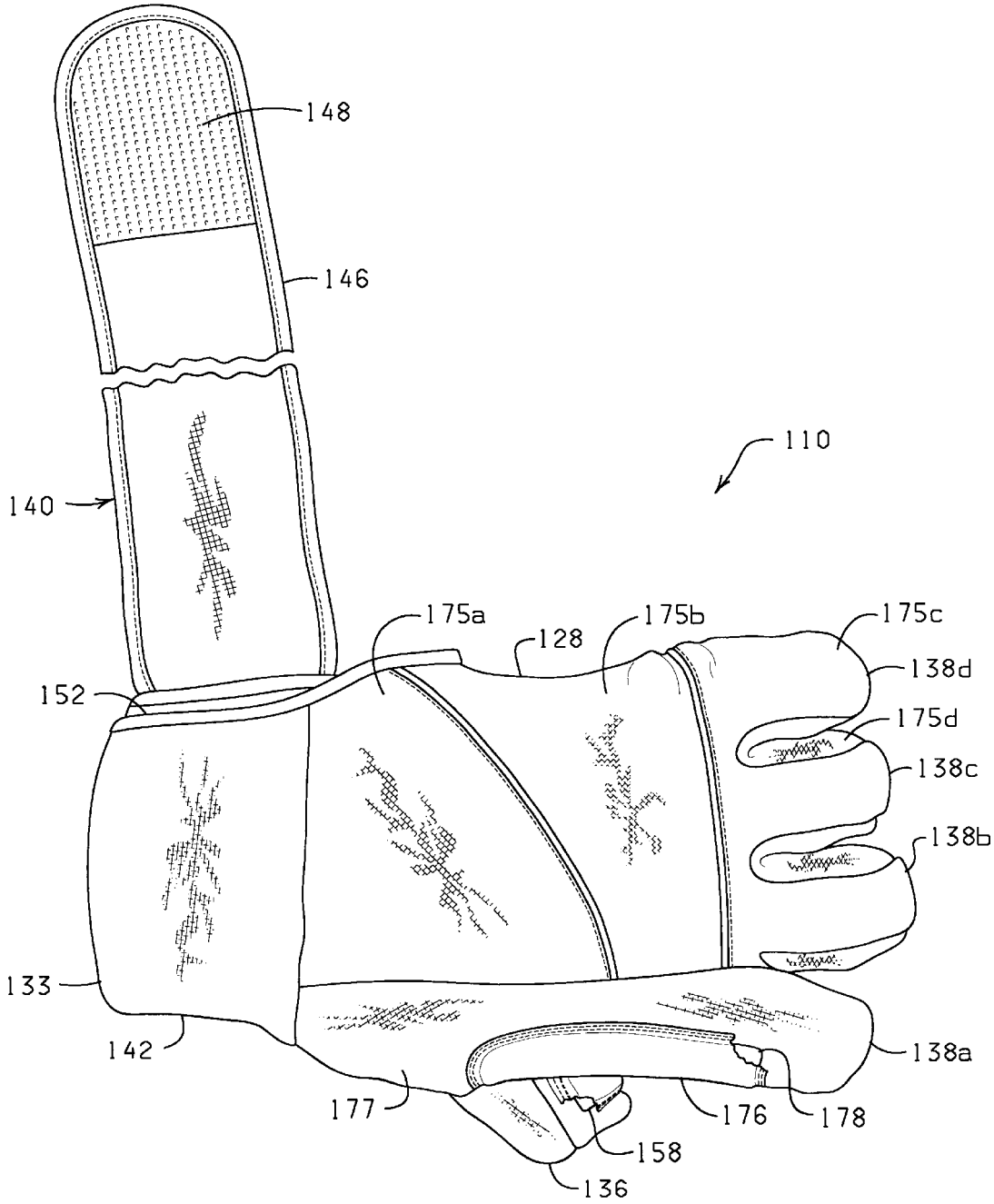
FIG. 7 is a plan view of the back covering of the glove of FIG. 5.

As shown in FIGS. 5–7, the glove 110 further includes a strap assembly 140 for securing the glove 110 about the wrist of the individual. The strap assembly 140 includes a cuff 142 extending circumferentially about the glove opening 133. The cuff 142 is preferably constructed of an elastic material. The strap assembly 140 further includes a support strap 146 extending from the cuff 142. The support strap 146 is provided with a length that permits the support strap 146 to be wrapped about the cuff 142 approximately 1¼ to ½ times thereby providing support to the individual's wrist. The support strap 146 is provided with a hook and loop type fastener patch 148 (FIG. 7) on the interior surface of the support strap 146 near the distal end thereof which is adapted to be connected to a corresponding hook and loop type fastener patch 150 (FIG. 6) secured to the exterior surface of the support strap 146 near the proximal end thereof.

A slit 152 is provided between the palm covering 126 and the back covering 128 to permit the glove 110 to be adjustably fastened to the individual's hand 112 upon mating the hook and loop type fastener patch 148 with the hook and loop type fastener patch 150 after wrapping the support strap 146 about the cuff 142, and yet permit the glove 110 to be easily removed from the individual's hand 112 upon releasing the hook and loop type fastener patch 148 from the hook and loop type fastener patch 150. It will be appreciated by those of ordinary skill in the art that numerous types of strap assemblies are known in the art which would be suitable for use in the glove 110, including the strap assembly 140 described above.

Referring now to FIG. 6, the palm covering 126 is shown to be shaped to substantially correspond to the shape of the palmar side of the individual's hand 112. The palm covering 126 is preferably constructed of a durable fabric, such as leather, suede, or synthetic equivalent.

The palm padding 130 is secured to selected areas of the palm covering 126. More specifically, the palm padding 130 includes a pad 153 positioned on the interior surface of the palm covering 126 and secured between the palm covering 126 and a patch or liner 154. The pad 153 is dimensioned to extend over a substantial portion of the palm covering 126 thereby substantially corresponding to the shape of the palm covering 126. The pad 153 is preferably constructed from a resilient, impact absorbing material. Materials such as natural or synthetic rubber; natural or synthetic rubber foams with either open or closed structures; polymeric foams with either open or closed structures (including, but not limited to polyurethane foams and polystyrene foams); and conventionally available impact absorbent gels which may or may not require a pliable membrane containment pouch may be suitable for construction of the pads.

The patch 154 is preferably fabricated of a moisture absorbing material, such as terry cloth. However, it will be appreciated that any suitable material can be used. The palm covering 126 is provided with a pair of lateral stitch lines 156 substantially corresponding with the distal and proximal creases of the hand 112 to facilitate movement of the hand 112. The palm padding 130 may further include an additional thumb pad 158 secured to the exterior side of thumb stall 136 with a patch 160 for providing additional protection to the thumb 122.

To enhance the individual's grip on an object, particularly when exerting a pulling force on an object, the slip resistant material 132 is provided on selected areas of the palm covering 126. As shown in FIG. 6, the slip resistant material 132 can be a plurality of raised friction elements 167 formed on a pair of webs of material 168 which are in turn secured to the palm covering 126 so as to extend longitudinally along the middle finger stall 138*b* and the ring finger stall 138*c* and across the palm covering 126 to a location adjacent the cuff 142. The webs of material 168 can be constructed of any material suitable for receiving the raised friction elements 167.

The raised friction elements 167 can be fabricated of any anti-slip material, such as rubber. Furthermore, the raised friction elements 167 may be formed directly on the palm covering 126 without use of the webs of material 168. A method of applying a resinous material to an elastic open mesh fabric in spaced globs on a narrow band to form friction protrusions on the material is disclosed in U.S. Pat. No. 3,647,505 issued to Bjorn-Larsen which is expressly incorporated herein by reference.

It will also be appreciated by those of ordinary skill in the art that the slip resistant material 132 can be any material that can be applied the entire palm covering 126 or only the channel 166 to provide a tackified surface in a manner well known in the art.

To further enhance the individual's grip, the finger stalls 138*b* and 138*c* are provided with raised areas to provide areas of increased thickness relative to the remainder of the palm covering 126 to enhance leverage on the object gripped by the individual. More particularly, each of the webs of material 168 is provided with a raised edge 170 on the finger end of the webs of material 168. The raised edges 170 may be formed by overlapping the end of the webs of material 168 to form a hem and securing a padding 172 within the hem. Because the raised edges 170 provide for an increased thickness relative to the remaining portion of the palm covering 126, leverage on the object being gripped by the individual is increased, thereby enhancing the individual's grip on the object.

The heel end of the webs of material 168 can be reinforced with a web of material 174 which serves to prevent the edges of the webs of material 168 located at the heel end thereof from catching on other objects.

Referring now to FIG. 7, the back covering 128 is shaped to substantially correspond to the shape of the dorsal side of the individual's hand 112. The back covering 128 is preferably constructed, at least in part, of a breathable, stretch knit fabric, such as LYCRA SPANDEX, so that the back covering 128 conforms to the contour of the dorsal side of the individual's hand 112. In particular, the back covering 128 is shown to be constructed of a first material 175*a,* a second material 175*b,* a third material 175*c,* and a fourth material 175*d.* By way of example, the first material 175*a* can be LYCRA SPANDEX, the second material 175*b* LYCRA SPANDEX, the third material 175*c* leather, and the fourth material 175*d* nylon. The back covering 128 may further include a moisture absorbing panel 177 constructed of a material such as terry cloth, so as to permit the individual to wipe perspiration from his face when exercising. The moisture absorbing panel 177 extends along the thumb stall 136 and the finger stall 138*a* and down toward the glove opening 133.

The back covering 128 is further provided with a reinforcing patch 176 secured to an area between the thumb stall 136 and the finger stall 138*a* to provide additional protection to the corresponding portion of the individual's hand 112 when performing certain exercises such as an exercise commonly referred to as a "hammer curl" with a dumbbell. A pad 178 is shown interposed between the back covering 128 and the reinforcing patch 176 to provide additional protection. The thumb pad 158 described above in reference to the palm covering 126 is further extended around the thumb stall 136 to cooperate with the reinforcing patch 174 to protect the individual's hand 112 during such an exercise and also to cushion the thumb 122 of the individual when the individual is gripping a weight lifting implement.

Figure 8:
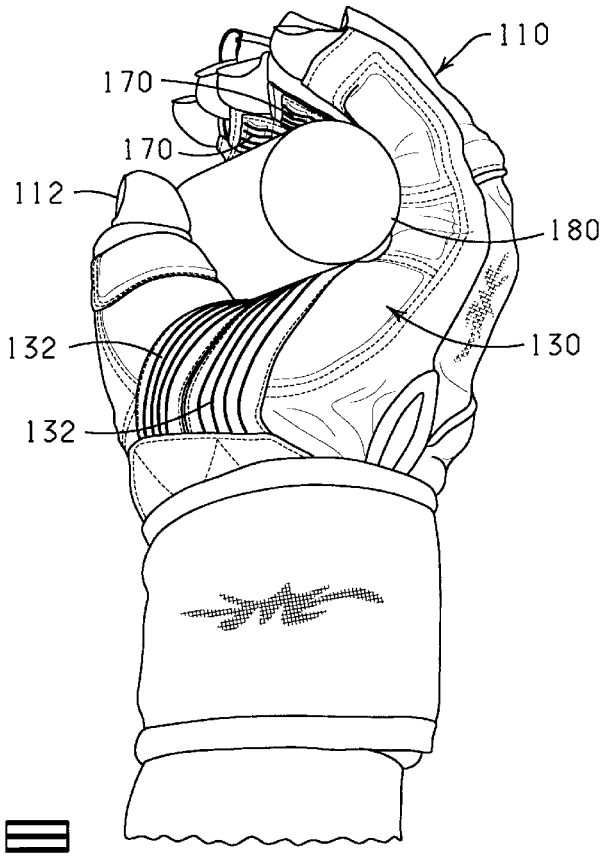
FIG. 8 is a side elevational view of the glove of FIG. 5 shown gripped about a weight lifting implement.
Figure 5:
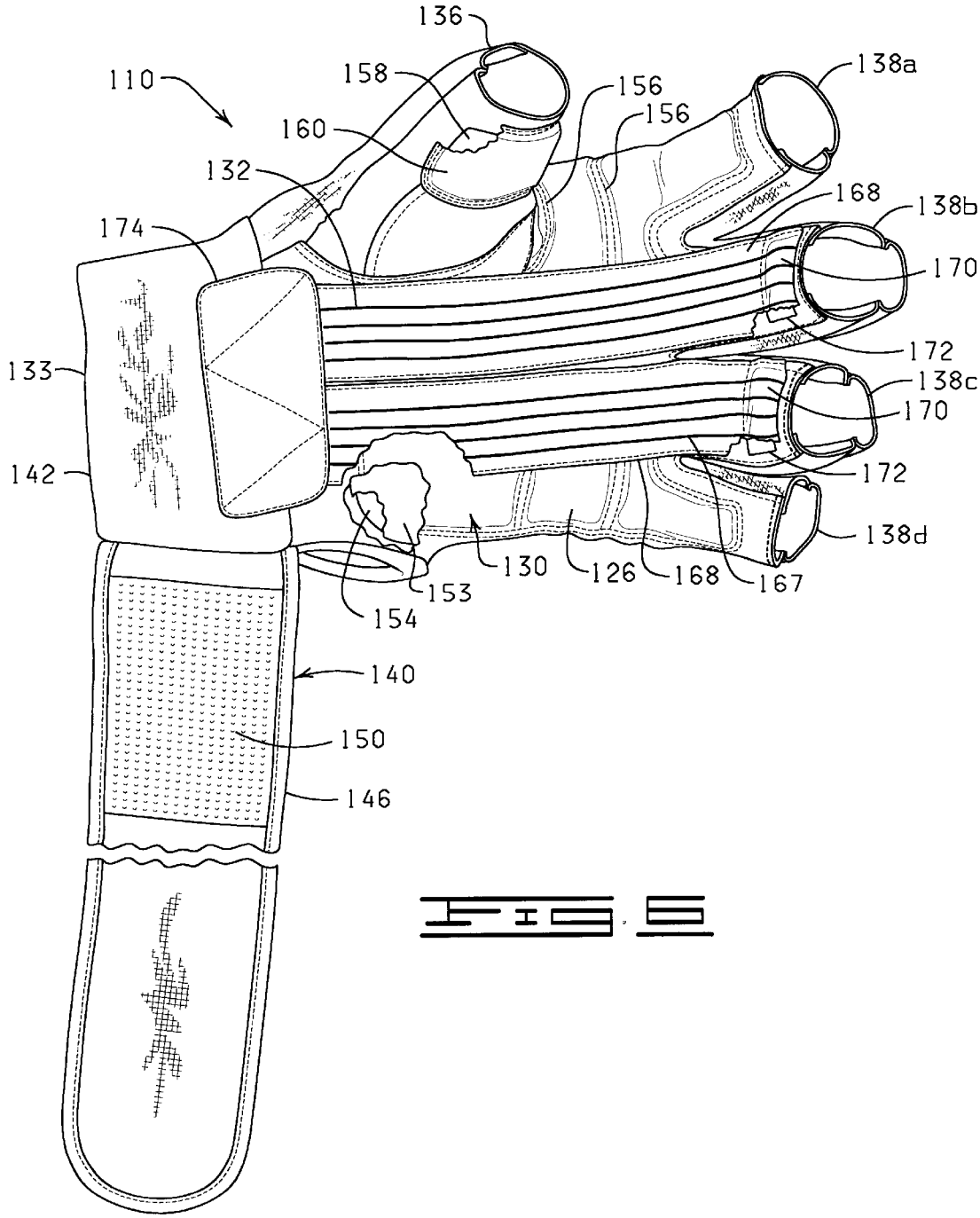

Referring now to FIG. 8, the glove 110 is shown donned on the hand 112 of an individual and being utilized to grip an object, such as a weight lifting bar 180. The unique construction of the glove 110 permits the individual to tightly grip the weight lifting bar 180 without having to expend any unnecessary energy, while also cushioning providing the portions of the individual's hand 112 most susceptible to injury, namely the heel, thumb and fingers. This is accomplished by the combination of the palm padding 130 and the raised friction elements 132. With the weight lifting bar 180 positioned across the palm covering 126, as shown, and the individual's hand 112 gripped about the weight lifting bar 180, the increased thickness provided by the raised edges 170 of the webs of material 168 increases the leverage exerted on the weight lifting bar 180 by the individual. The grip on the weight lifting bar 180 is further enhanced by the engagement of the weight lifting bar 180 with the raised friction elements 132 positioned longitudinally across the palm covering 126.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls;

a palm padding secured to selected areas of the palm covering so as to provide cushioning for the palmar side of the individual's hand; and a slip resistant material provided on selected areas of the palm covering to facilitate the gripping of an object by the individual's hand, wherein the palm covering has a lower portion which substantially corresponds with a heel portion of the individual's hand and wherein the palm padding is secured to the lower portion of the palm covering and at least a portion of the finger stalls so as to form a channel for receiving the object gripped by the individual's hand, the channel having a length extending transversely across a medial portion of the palm covering and a width extending from the lower portion of the palm covering to the finger stalls.

2. The glove of claim 1 wherein the slip resistant material is positioned along at least a portion of the channel to enhance frictional engagement of the object positioned in the channel and gripped by the individual.

3. The glove of claim 2 wherein the slip resistant material is fabricated of rubber.

4. The glove of claim 2 wherein the slip resistant material is a plurality of raised friction elements formed on a web of material which is attached to the palm covering along the channel.

5. The glove of claim 2 wherein the slip resistant material is a plurality of raised friction elements formed on a plurality of webs of material, each of the webs of material secured to the palm covering so as to extend along the length of the channel in a substantially parallel relationship with respect to an adjacent one of the webs of material.

6. The glove of claim 1 wherein the channel is void of the palm padding.

7. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls; and a palm padding secured to selected areas of the palm covering so as to provide cushioning for the palmar side of the individual's hand, the palm padding including a heel pad secured to a lower portion of the palm covering which substantially corresponds with a heel portion of the individual's hand and a plurality of finger pads secured to each of the finger stalls, the heel pad and the finger pads cooperating to form a channel for receiving an object gripped by the individual's hand, the channel having a length extending transversely across a medial portion of the palm covering and a width extending from the lower portion of the palm covering to the finger stalls.

8. The glove of claim 7 wherein the palm padding further includes a thumb pad secured to the thumb stall and is dimensioned to provide an area of increased thickness relative to the channel which cooperates with the heel pad and the finger pads to enhance leverage on the object positioned in the channel and gripped by the individual.

9. The glove of claim 8 wherein the heel pad, the thumb pad, and the finger pads are secured to the palm covering in a spaced apart relationship relative to one another.

10. a glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls; and a plurality of raised friction elements secured to selected areas of the palm covering to facilitate the gripping of an object by the individual's hand, the raised friction elements formed on a pair of webs of material, each of the webs of material being secured to the palm covering, one of the webs of material extends longitudinally along the middle finger stall and the other web of material extends longitudinally along the ring finger stall, each of the webs of material is defined as having a finger end and a heel end and wherein each of the webs of material is provided with a raised edge proximate the finger end to enhance the leverage on the object gripped by the individual.

11. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls;

a palm padding secured to selected areas of the palm covering so as to provide cushioning for the palmar side of the individual's hand; and a slip resistant material provided on selected areas of the palm covering to facilitate the gripping of an object by the individual's hand, wherein the palm covering has a lower portion which substantially corresponds with a heel portion of the individual's hand when the glove is donned on the individual's hand and wherein the slip resistant material is a plurality of raised friction elements secured to the palm covering so as to extend longitudinally along at least two of the finger stalls and across the palm covering to the lower portion thereof, wherein the slip resistant material extends over the palm padding.

12. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls including a middle finger stall and a ring finger stall;

a palm padding secured to selected areas of the palm covering so as to provide cushioning for the palmar side of the individual's hand; and a slip resistant material provided on selected areas of the palm covering to facilitate the gripping of an object by the individual's hand, wherein the slip resistant material is a plurality of raised friction elements formed on a pair of webs of material, each of the webs of material being secured to the palm covering, one of the webs of material extends longitudinally along the middle finger stall and the other web of material extends longitudinally along the ring finger stall, wherein each of the webs of material is defined as having a finger end and a heel end and wherein each of the webs of material is provided with a raised edge proximate the finger end to enhance the leverage on the object gripped by the individual.

13. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls including a middle finger stall and a ring finger stall;

a palm padding secured to selected areas of the palm covering so as to provide cushioning for the palmar side of the individual's hand; and a slip resistant material provided on selected areas of the palm covering to facilitate the gripping of an object by the individual's hand, wherein the slip resistant material is a plurality of raised friction elements formed on a pair of webs of material, each of the webs of material being secured to the palm covering, one of the webs of material extends longitudinally along the middle finger stall and the other web of material extends longitudinally along the ring finger stall, wherein the webs of material extend over the palm padding.

14. A glove for protecting an individual's hand, the individual's hand characterized as having a radial side, an ulnar side, a dorsal side, and a palmar side with a proximal crease and a distal crease, the glove comprising:

a palm covering shaped to substantially correspond to at least a portion of the palmar side of the individual's hand;

a back covering shaped to substantially correspond to at least a portion of the dorsal side of the individual's hand, the back covering secured to the palm covering so as to form a hand receiving opening, a thumb stall, and a plurality of finger stalls including a middle finger stall and a ring finger stall;

a palm padding secured to selected areas of the palm covering so as to provide cushioning for the palmar side of the individual's hand; and a slip resistant material provided on selected areas of the palm covering to facilitate the gripping of an object by the individual's hand, wherein the palm covering has a lower portion which substantially corresponds with a heel portion of the individual's hand when the glove is donned on the individual's hand and wherein the slip resistant material is a plurality of raised friction elements formed on a pair of webs of material, each of the webs of material being attached to the palm covering, one of the webs of material extends longitudinally along the middle finger stall and the other web of material extends longitudinally the ring finger stall to the lower portion of the palm covering in a parallel relationship.

15. The glove of claim 14 wherein each of the webs of material is defined as having a finger end and a heel end and wherein each of the webs of material is provided with a raised edge proximate the finger end to enhance the leverage on the object gripped by the individual.

16. The glove of claim 14 wherein the webs of material extend over the palm padding.

* * * * *

UNITED STATES PATENT AND TRADEMARK OFFICE

CERTIFICATE OF CORRECTION

PATENT NO. : 6,832,391 B1
APPLICATION NO. : 09/954345
DATED : December 21, 2004
INVENTOR(S) : Danny Michael Bower It is certified that error appears in the above-identified patent and that said Letters Patent is hereby corrected as shown below:

Column 6, line 3, delete "1/2" and substitute --1 1/2--.

Signed and Sealed this

Twelfth Day of September, 2006

JON W. DUDAS
*Director of the United States Patent and Trademark Office*